United States Patent [19]

Joy

[11] 4,156,955

[45] Jun. 5, 1979

[54] METHOD AND APPARATUS FOR PRESHRINKING CLOTH

[75] Inventor: Herman J. Joy, Latham, N.Y.

[73] Assignee: Cluett, Peabody & Co., Inc., New York, N.Y.

[21] Appl. No.: 810,854

[22] Filed: Jun. 28, 1977

Related U.S. Application Data

[63] Continuation-in-part of Ser. No. 598,562, Jul. 24, 1975, abandoned.

[51] Int. Cl.[2] ..... D06C 21/00

[52] U.S. Cl. ..... 26/18.6

[58] Field of Search ..... 26/18.6; 34/111, 123; 428/268

[56] References Cited

U.S. PATENT DOCUMENTS

| | | | |
|---|---|---|---|
| 1,971,211 | 8/1934 | Cluett | 26/18.6 |
| 2,199,011 | 4/1940 | Schreiner | 26/18.6 |
| 2,825,117 | 3/1958 | Evans et al. | 26/18.6 X |
| 3,709,721 | 1/1973 | King | 428/268 X |

FOREIGN PATENT DOCUMENTS

| | | | |
|---|---|---|---|
| 494132 | 3/1950 | Belgium | 26/18.6 |
| 1110734 | 10/1955 | France | 26/18.6 |

*Primary Examiner*—Robert Mackey

[57] ABSTRACT

A cloth web preshrinking apparatus is disclosed including an inlet roller, a heated drum and a blanket (usually a felt type endless blanket) running on the inlet roller and then onto an outer face of the drum. A first initial outer surface of the blanket is stretched and then compacted. A cloth web is introduced into frictional contact onto the first surface of the blanket as it is stretched and the cloth web is then preshrunk as the first surface is compacted. A smooth strong flexible sheet of Teflon coated resin bonded glass fiber material (in the form of an apron or endless ribbon at least as wide as the cloth web) presses the cloth web onto the inlet roller and thereafter the sheet extends in contact with the cloth web on an upper face thereof onto the outer face of the drum.

5 Claims, 8 Drawing Figures

METHOD AND APPARATUS FOR PRESHRINKING CLOTH

CROSS REFERENCE TO RELATED APPLICATIONS

This application is a continuation-in-part of copending United States Application Ser. No. 598,562 filed July 24, 1975, now abandoned.

BACKGROUND OF INVENTION

This invention relates to a cloth web preshrinking apparatus of a type including an inlet roller, a heated drying drum and a shrinking blanket running onto the inlet roller and thence against an outer surface of the heated drum.

More particularly this invention relates to preshrinking, stabilizing and/or finishing knitted cloth webs. In knitted cloth, as distinguished from woven cloth, the cloth is constructed in both its lengthwise and widthwise directions by series of interlocked loops formed by continuous yarns or series of continuous yarns. As a result knitted cloth has substantial interdependence of its length and width dimensions which results in a property of being distortable easily. This distortion property has made knitted cloth desirable for many articles of apparel, because of ability of garments made from knitted cloth to conform kinesiologically to bodies and to change their shapes in response to body movements of their wearers. However this distortion property, which enhances acceptability of knitted cloth for wearing apparel, presents problems in preshrinking, stabilizing and finishing the knitted cloth webs.

Reference should be made to FIG. 6 of the drawings in regard to the following explanation. In known type of apparatus for preshrinking, stabilizing and/or finishing a knitted cloth web, as referred to before herein, a blanket 11 (usually a felt endless blanket) is led over an inlet roller 12 thereby having a first (initially outer) surface 13 of the blanket 11 stretched in a zone 14. Then the inlet roller 12 and the blanket 11 are held firmly in a nip area against an outer surface of a large diameter, rotated heated drum 15 around an arc of which the blanket 11 passes after leaving the inlet roller 12. In transferring from the inlet roller 12 to the drum 15 at the nip area, the blanket 11 reverses its curvature so that the first surface 13 of the blanket 11 contracts along its length in a compaction zone 16.

Because of the distortion property of knitted cloth, there is a tendency for the knitted cloth to lose its preshrinkage or pop out.

Electrically heated shoes 17 are provided to firmly hold the fabric 18 pressed against the working surface 13 of the blanket as the fabric is brought into engagement with the latter. Preferably the shoes press the fabric tightly against the surface 13 right into the nip area between the blanket and the drum, but due to the necessity of providing mechanical clearance between the shoes 17 and the moving surface of the drum 15, the shoes 17 used in the prior art could not maintain compression between the fabric 18 and the blanket 11 in the transition area 16 between the end of the shoes 17 and the drum 15. Because the fabric 18 is in moistened and relaxed condition before reaching the feed roller 12, it is desirable to maintain the fabric firmly against the blanket right up to the nip area between the blanket and the drum to avoid tension problems in the fabric and to prevent "pop out" of the fabric away from the blanket as it traverses the feed roller. The pop out problem is particularly troublesome with knit fabrics due to their low distortion resistance.

The cloth web 18 is fed onto the surface 13 of the blanket 11 where the surface 13 is stretched in the zone 14 due to curvature of the blanket 11 around the roller 12 and the cloth web 18 is held in contact with this surface 13, initially by means of the shoes 17 which are heated to prevent friction or sticking and then the web cloth is heated by the drum 15. As the cloth web 18 reaches a point where reversal of curvature of the blanket 11 shortens the stretched condition of the surface 13 back to normal and beyond to a contracted condition in the compaction zone 16, the cloth web 18 is compelled to shorten also because the cloth web 18 is in frictional contact with the surface 13 of the blanket 11. This shortening action is a continuous one of microscopic amounts at any instant, but which can typically total 6 inches (15.24 cm.) or more per yard (91.44 cm.) depending on thickness and material of the blanket 11 with which the apparatus is equipped.

The cloth 18 is moist before it reaches and passes under the shoes 17, so that being soft and somewhat plastic the cloth web 18 contracts readily in frictional contact with the surface 13 of the blanket. Removal of moisture by means of complete drying of the cloth web 18, by travel of the cloth web 18 over the heated drum 15, stabilizes and finishes the cloth web 18 in its contracted or preshrunk stage.

Difficulties arise in maintaining the heated shoes 17 in accurate position relative to the inlet roller 12 and with respect to the heated drum 15. The shoes 17 must generally be heated electrically and they, as well as the blanket 11, are subjected to considerable wear. The shoes 17 inevitably offer resistance to the cloth web 18 passing thereunder, which resistance increases power requirements of the apparatus. The shoes 17 are mechanically complex and expensive to repair. Adjustments of the shoes 17 and replacements of the roller 12 are necessary frequently; which adjustments and replacements make operation of the apparatus complicated, thereby increasing operator skill requirements as well as aggrevating probabilities of mistakes and presenting inherent operational errors. It is necessary to change to a larger inlet roller as the blanket wears since the position of the shoes is generally fixed.

STATEMENT OF INVENTION

This invention solves difficulties of the prior art in a useful, novel, unobvious and particularly facile way. A smooth strong flexible sheet (in the form of an apron or endless ribbon at least as wide as the cloth web) presses the cloth web onto the inlet roller. Thereafter the sheet continues in contact with the upper face of the cloth and the outer face of the drum. Accordingly one object of this invention is to eliminate the heated shoes and thereby save a major portion of their capital, maintenance and adjustment costs.

Another object of this invention is to provide the pressing sheet in either the form of an apron or in the form of an endless ribbon.

Still another object of this invention is to enable the fabric to be pressed against the blanket at an area closer to the drum than had been achievable by prior art apparatus.

Still another object of this invention is to eliminate popping out of knitted cloth webs.

In addition to knitted cloth webs of yarns composed of cellulosic fibers, cloth webs knitted of yarns composed of blends of cellulosic fibers and man made thermoplastic fibers can also be preshrunk as well as set thermally and finished using the apparatus of this invention. Thus it is a further object of this invention to achieve preshrinking, stabilizing and finishing of blended cloth webs accurately and uniformly whereby to provide desirable, predictable and reproducible finished cloth webs.

Still another object of this invention is to preshrink, stabilize and finish cloth in the form of flattened knitted tubes as well as in the form of slit open knitted tubes and warp knitted open webs with selvages.

Still another object of this invention is to accommodate on a single piece of apparatus preshrinking, stabilizing and finishing of cloth in the form of flattened knitted tubes as well as in the form of slit open knitted tubes and warp knitted open webs with selvages.

Still another object of this invention is to preshrink, stabilize and finish woven cloth webs.

Still another object of this invention is to apply greater pressure to cloth webs on the inlet roller than had been achievable with the shoes.

Still another object of this invention is to reduce the frequency of inlet roller replacements.

Still another object of this invention is to obviate adjustment problems of the shoes in that axial translations of the input roller and of the ribbon roller are simple. In fact, in accordance with this invention, the inlet roller need not be adjusted at all during production runs nor be replaced due to blanket wear.

Still another object of this invention is to permit adjustments without stopping the apparatus.

Still another object of this invention is to avoid the necessity for changing blanket sizes to change preshrinkage ability of the apparatus.

Still another object of this invention is to reduce power requirements of the apparatus, by eliminating the shoes and with them the energy required to heat them.

Still another object of this invention is to extend operating runs of the apparatus.

Still another object of this invention is to provide an apparatus which can cooperate with an additional apparatus of its own type or other types to increase preshrinkage capability and/or to produce a finished appearance on both surfaces of a cloth web.

Still another object of this invention is to provide a more uniform preshrinking, stabilizing and finishing than has been achieved by prior art apparatus.

Still another object of this invention is to provide apparatus which is capable of producing a desired degree of preshrinking without overshrinking.

Still another object of this invention is to produce apparatus by which the degree of preshrinking can be varied conveniently and reliably.

Still another object of this invention is to produce apparatus which can cooperate with other types of preshrinkage units, such as rubber belt units to prevent pop out and to add additional preshrinking.

Still another object of this invention is to produce apparatus which can serve in drying a fabric web and preventing pop out after preshrinking on any type of preshrinkage unit. Other objects will become evident from the following description and claims.

Still another object of this invention is to provide apparatus of the character stated which is suited well otherwise to its intended functions.

DESCRIPTION OF DRAWINGS

The foregoing and other objects, features and advantages will appear more fully from a detailed description of certain preferred embodiments of the invention which follows and from claims which also follow all viewed in conjunction with drawings, which accompany and form part of this application, wherein same numerical designations refer to like parts throughout and wherein:

DESCRIPTION OF PREFERRED EMBODIMENTS

Figure 1:
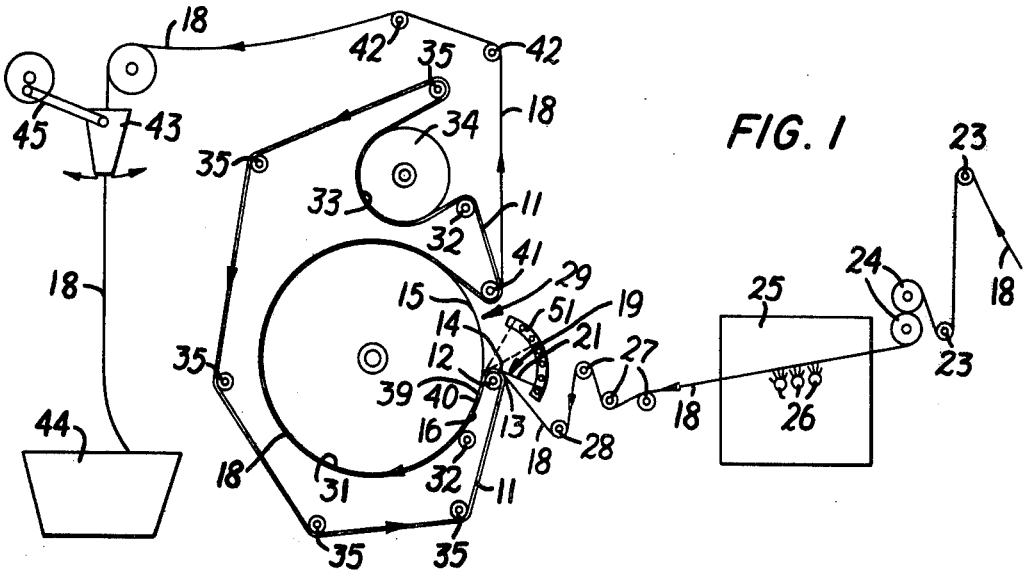
FIG. 1 is a simplified schematic side elevational view of one embodiment of apparatus for processing a cloth web in accordance with this invention.
Figure 2:
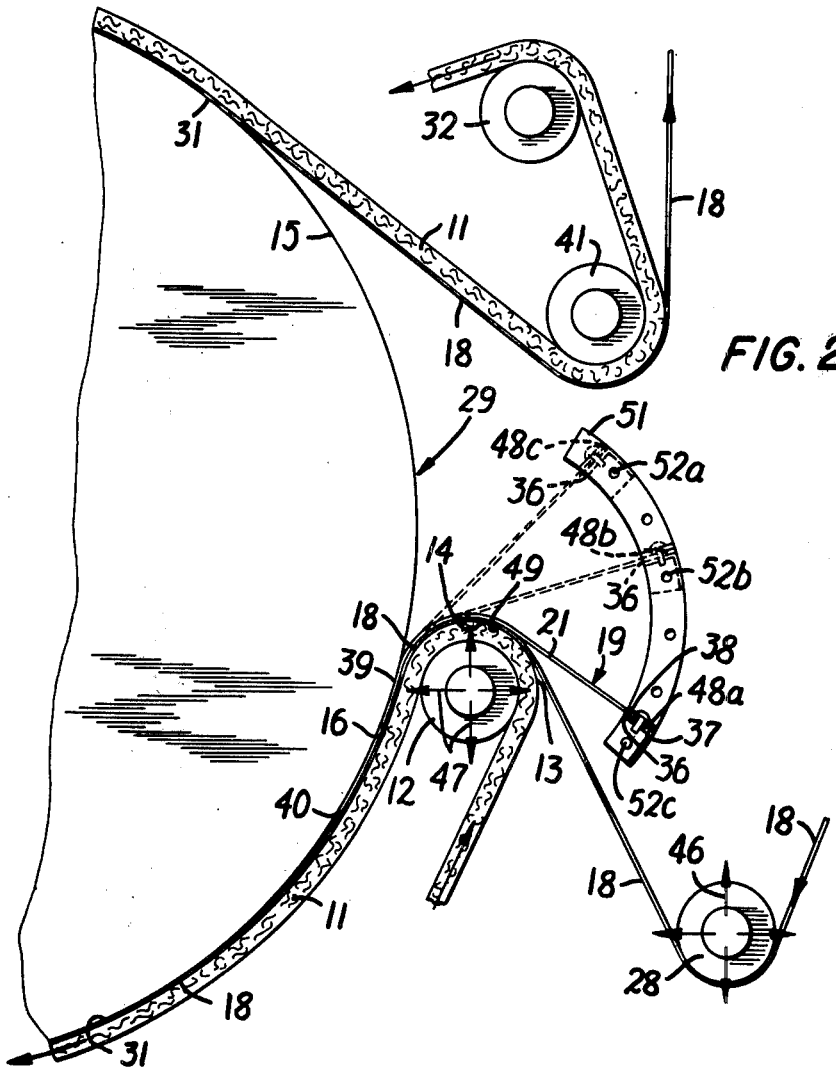
FIG. 2 is a simplified view of an enlarged scale depicting a pressing sheet 19 of FIG. 1 in the form of an apron 21 and showing the relationship of the apron 21 to the blanket 11, the inlet roller 12, the drum 15 and the cloth web 18 being processed.
Figure 3:
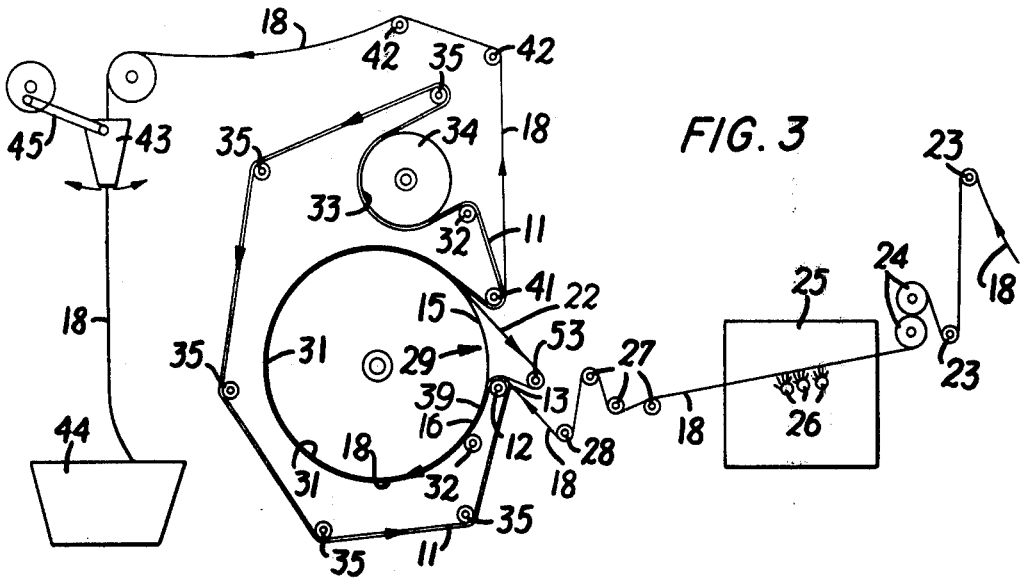
FIG. 3 is a simplified schematic side elevational view of another embodiment of apparatus for processing a cloth web in accordance with this invention.
Figure 4:
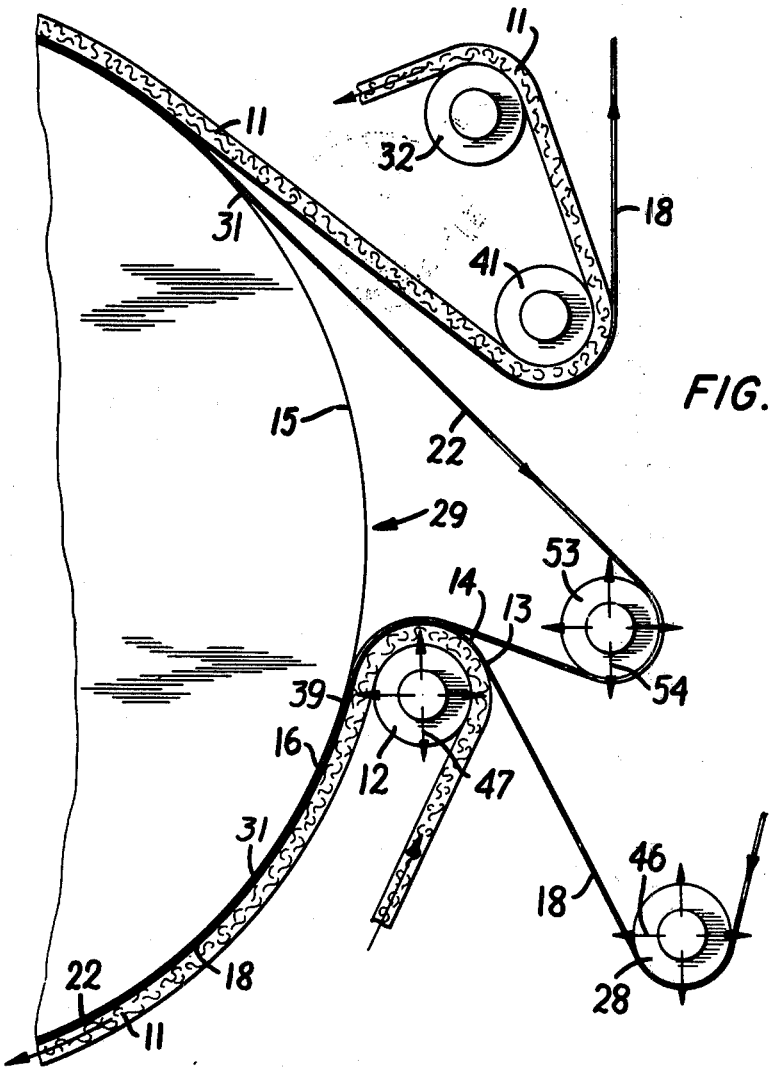
FIG. 4 is a simplified view to an enlarged scale depicting a pressing sheet in the form of an endless ribbon 22 and showing the relationship of the endless ribbon 22 to the blanket 11, the inlet roller 12, the drum 15 and the cloth web 18 being processed.
Figure 6:
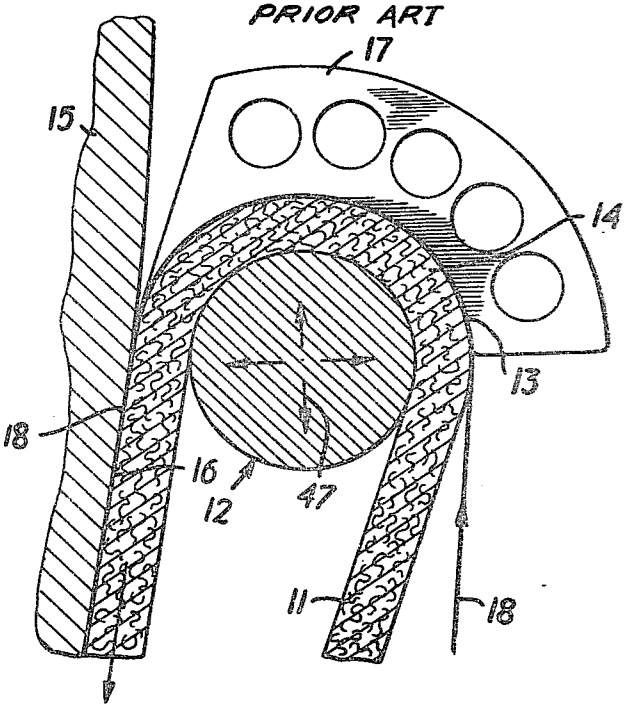
FIG. 6 PRIOR ART
FIG. 6 is a simplified detail of a prior art electrically heated shoe 17 and its relationship to the blanket 11, the inlet roller 12, the drum 15 and the cloth web 18 being processed.
Figure 5:
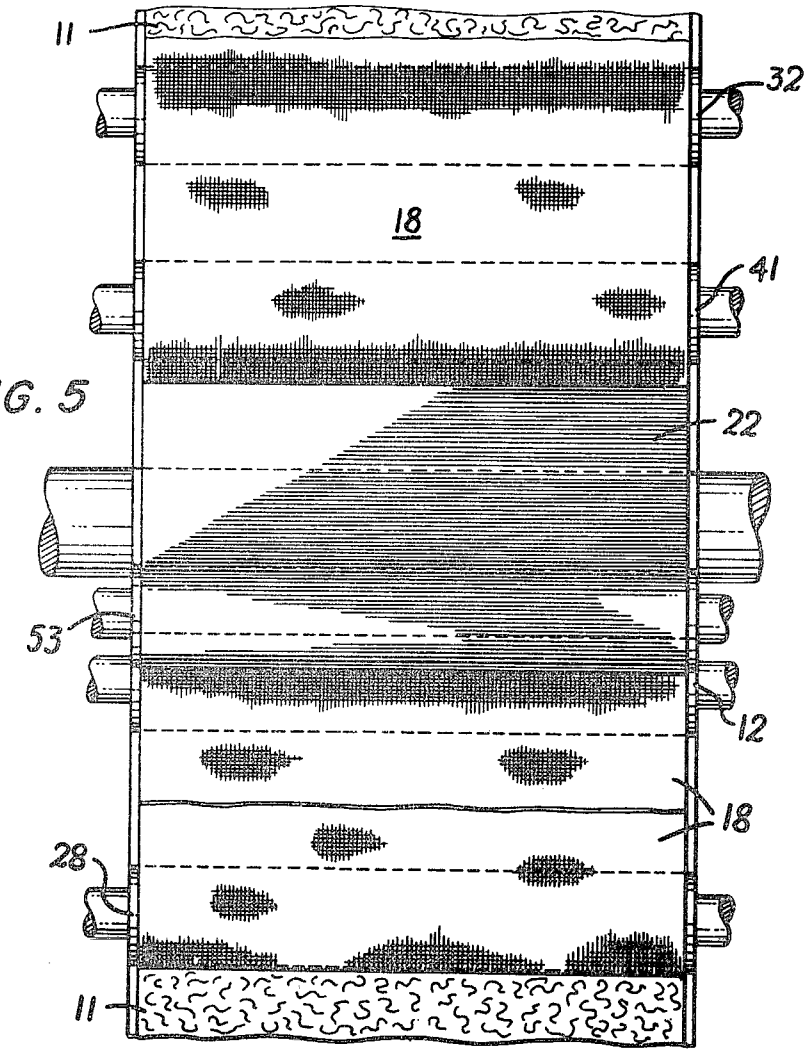
FIG. 5 is a simplified right end view of the embodiment shown in FIG. 4.

The crux of this invention is to replace prior art pressing shoes 17 shown in FIG. 6 by a pressing sheet 19 which preferably takes the form of an apron 21 as in the embodiment shown in FIGS. 1–2 or alternatively may take the form of an endless ribbon 22 in the embodiment shown in FIGS. 3–5.

By way of example, in the preferred embodiment shown in FIGS. 1–2, the cloth web 18 typically may be fed via guide rollers 23 and draw rollers 24 through a moisturizing device 25 wherein the cloth web 18 has its moisture content adjusted by spraying with steam and/or water from nozzles 26 and whence the moistened cloth web 18 is conducted and spread by known means (shown typically as rollers 27) to an adjustable feed roller 28 whence it enters a principal process unit (generally designated 29) of this invention. The foregoing preliminary apparatus is conventional. It is necessary only that the moisture content of the cloth web 18 be in a range compatible with compressive preshrinking and usually that the cloth web be spread and relaxed properly, for example in a rail tenter with a feed such as a Marshall & Williams nip type overfeeder. Variations on the preliminary apparatus include partial drying typically over hot cans, delivery of the cloth web 18 from a rubber belt 55 (shown in FIG. 7) or other compressive preshrinkage unit such as one for cloth knitted into tubes (shown in FIG. 8) or from other preliminary apparatus. Also the spreading as well as the relaxing could be attended to before the moisturizing, so long as the cloth web 18 reaches the principal processing unit 29 of this invention with a compatible moisture content, spread and usually relaxed. Woven cloth and warp knitted cloth are handled easily, but a knitted tube has to be slit and spread or flattened with all of the foregoing being accomplished by known apparatus and techniques.

The blanket 11 (typically a felt endless blanket) is led over an arc of the inlet roller 12 thereby having the surface 13 of the blanket 11 stretched in the stretch zone 14. Then the inlet roller 12 and the blanket 11 are held in contact against the large diameter heated drum 15 around an arc of which the blanket 11 passes after leaving the inlet roller 12. In transferring from the roller 12 to the drum 15, the blanket 11 reverses its curvature so that the stretched surface 13 of the blanket 11 changes to a contracted surface in a compaction zone 16. The blanket 11 is very suitably made of woven wool or of needled polyester. With elimination of the heated shoes 17, it is feasible to employ blankets 11 of synthetic fibers which cannot be used with heated shoes 17 due to the fact that the temperature required (375° F. to 450° F. or 190.6° C. to 232.2° C.) would melt and destroy the blanket. However, using pressing sheet 19, in the form of an apron 21 or an endless ribbon 22, with a maximum drum temperature of approximately 325° F. or 162.8° C. permits safe use of the synthetic blanket. Additionally, such a maximum drum temperature also permits use of blankets of other fibrous materials which likewise are longer lasting than wool.

The blanket 11 courses to the roller 12, thence around an arc 31 of the drum 15, thence via guide rollers 32 around an arc 33 of a heated drum 34 and via guide rollers 35, the blanket is recycled back to the roller 12.

In the embodiment of FIGS. 1–2, the processing sheet 19 is in the form of a fixed pressing apron 21 which is clamped at an outer end 36 outward of the inlet inlet 12 relative to the drum 15. Held between an angle iron 37 and a bar 38 (as best seen in FIG. 2), the pressing apron 21 extends over the roller 12 through a nip area 39 and onto the arc 31 of the drum 15 where it is subjected to drag forces by the moving drum surface as well as by the fabric 18 drag forces. The tension presses the apron 21 over the roller 12 and maintains the apron 21 compressed on the cloth web 18 as the cloth web 18 traverses the roller 12, the nip area 39 and the arc 31 of the drum 15. The apron 21 extends uninterruptedly onto the arc 31 of the drum 15 to an inner end 40 far enough to develop sufficient drag from the drum and moving cloth web 18 to achieve the pressing force required. The pressing force is exerted radially of the roller 12, of course, towards the working surface of the blanket. By this expedient compressive preshrinking of the cloth web 18 is enabled, without pop out. Thereafter the cloth web 18 is dried totally in coursing the arc 31 on the drum 15 and the dried cloth web is conducted via an outlet roller 41 and guide rollers 42 typically to a plaiter 43 whereby the cloth web 18 is folded for deposition into a cart 44 for transfer to other processing steps or to conversion steps. The shown plaiter 43 is operated by means of a crank 45. Obviously other means for removal and further processing or conversion of the cloth will be apparent to skilled artisans.

Adjustments can include conventional controls and manipulations of the cloth web 18 in advance of the principal processing unit 29 of this invention, most particularly by adjustment of the feed roller 28 (as indicated by arrows 46) and also by movement of the roller 12 (as indicated by arrows 47) relative to the drum 15. The outer end 36 of the apron 21 can be held in various positions **48*a*, 48*b*, 48*c*, so that length of the arc 49 of the inlet roller 12 over which the apron 21 presses the cloth web 18 onto the inlet roller 12 can be predetermined. To achieve this adjustable positioning of the outer end 36 of the apron 21, a biased arcuate frame 51 preferably is provided with a series of pin holes 52*a*, 52*b*, 52*c* on which pins connected to the angle iron 37 and the bar 38 holding the outer end 36 of the apron 21 can be set. Moving the roller 12 closer to the drum, of course, will increase tension on apron 21** by increasing drag forces.

In the embodiment shown in FIGS. 3–5, the sheet 19, rather than being in the form of an apron 21 as shown in FIGS. 1–2, is in the form of an endless ribbon 22 which courses around the arc 31 of the drum 15, being driven thereby. The endless ribbon 22 courses outward from the drum 15 past the inlet roller 12 and it passes over a ribbon tension roller 53 mounted in the vicinity of the inlet roller 12. The roller 53 has an axis which is parallel to the axis of the inlet roller 12. The ribbon roller axis is translatable axially relative to the inlet roller axis (as shown by arrows 54) to control tension in the endless ribbon 22 and also to vary the angle of incidence of the endless ribbon 22 as it passes over the inlet roller 12. As seen best in FIG. 5, the cloth web 18 has a substantially constant width and the endless ribbon 22 has a width at least as wide as that of the cloth web.

The apron 21 and the endless ribbon 22 are made of fabric constituted of resin bonded glass fibers coated with polytetrafluoroethylene resin. Thickness in the order of 0.016 inches (0.041 cm.) have proven to be practical. Joining of the endless belt has been achievable by conventional techniques.

It will be understood by skilled artisans that the cloth web may be woven or it may be a warp knitted open web, a slit knitted tube or a flattened knitted tube. The fibers may also be cellulosic or blends of cellulosic and man made fibers and such man made fibers may be thermoplastic.

Figure 7:
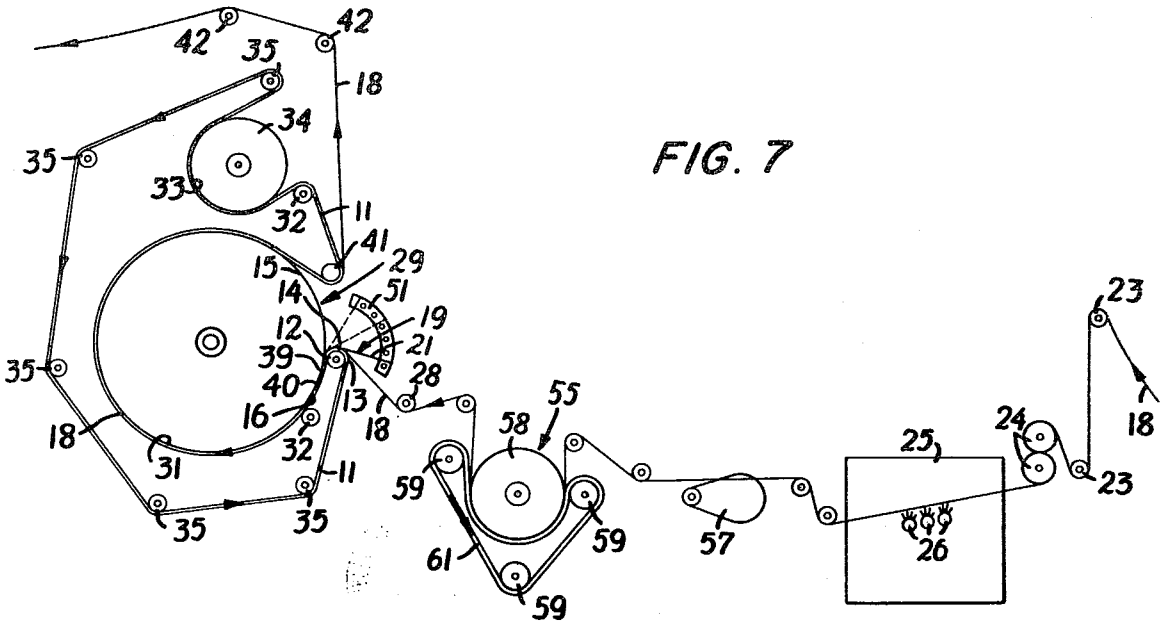
FIG. 7 is a simplified schematic side elevational view of the embodiment shown in FIG. 1 coupled in tandem with a conventional rubber belt compressive preshrinkage unit.
Figure 8:
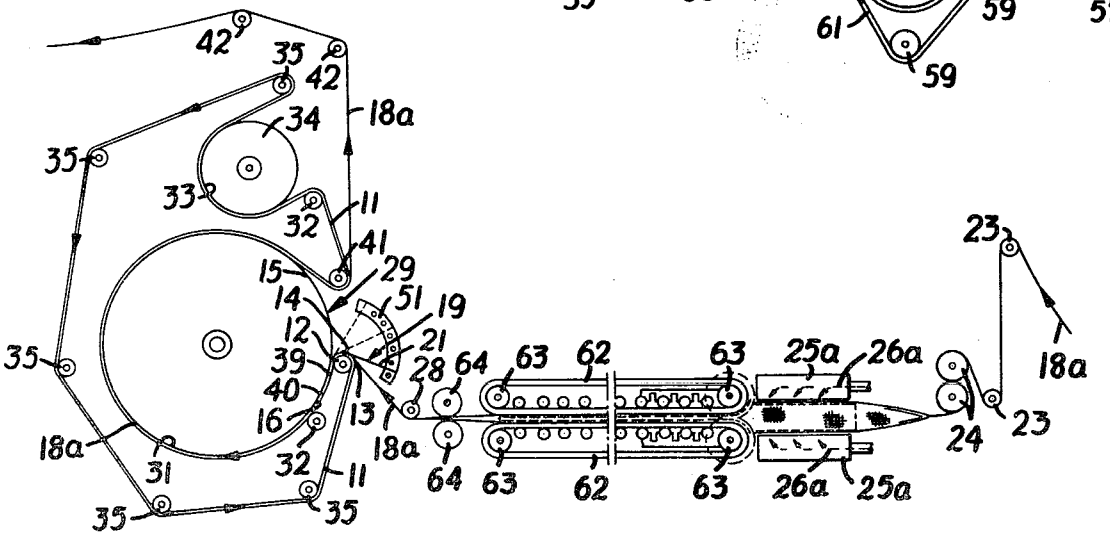
FIG. 8 is a simplified schematic side elevational view of the embodiment shown in FIG. 1 coupled in tandem with a conventional preshrinkage unit for cloth knitted in tubes.

The apparatus for processing cloth in accordance with this invention may be used in tandem advantageously with other compressive preshrinkage apparatus such as a conventional rubber belt compressive preshrinkage unit 55 shown in FIG. 7 which is preceded by a spreader 57 and comprises a heated drum 58, rollers and a moveable thick rubber belt 61. The apparatus for processing cloth in accordance with this invention is shown in FIG. 8 in tandem with a conventional preshrinkage unit for cloth **18*a* knitted in tubes. In FIG. 8, the knitted tube is spread and steamed in a moisturizing device 25*a* by means of steam jets 26*a* and it is then flattened and compacted by dual endless rubber belts 62 which run on rollers 63. After spreading by rollers 64 the flattened tube is brought to feed roller 28** whence it is processed in accordance with this invention. By this expedient pop out of the knitted tube is compensated for and additional preshrinking can be achieved.

It will also be apparent to skilled artisans that wide deviations may be made from the foregoing preferred embodiments, without departing from a main theme of the invention as set forth in claims which follow.

I claim:

1. An apparatus for compressively preshrinking a cloth web; the apparatus comprising in combination:

a heated drum having a drum axis, an inlet roller mounted adjacent to the drum and having an axis parallel to the drum axis, a blanket running around an arc of the inlet roller and thence around an arc of the drum in such a manner that a first initially outer surface of the blanket stretches in passing around the arc of the inlet roller and the first surface then contracts as it passes onto the arc of the drum, means for introducing the cloth web in a moistened condition onto the first surface of the blanket with the first surface carrying the cloth web in frictional contact therewith as at least a portion of said stretching and at least a portion of said contracting occurs;

the apparatus characterized by:

a smooth strong flexible sheet held in pressing engagement onto the cloth web on the arc of the inlet roller and extending inward of the cloth web onto the arc of the drum, the sheet being a fabric consisting of resin bonded glass fibers coated with polytetrafluoroethylene resin.

2. The apparatus of claim 1 with the sheet being an apron having an outer end substantially parallel to the axis of the inlet roller and outward of the inlet roller relative to the drum and the apron having an inner end extending onto the arc of the drum.

3. The apparatus of claim 1 with the sheet being a ribbon formed in an endless path substantially encircling the drum, a ribbon roller being adapted to have the ribbon pass about an arc thereof and the ribbon roller mounted in the vicinity of the inlet roller and having a ribbon roller axis parallel to the inlet roller axis.

4. The apparatus of claim 3 with means for translating the ribbon roller axis relative to the inlet roller axis for controlling incidence of the ribbon onto the cloth web.

5. A method for compressively preshrinking, stabilizing and finishing a cloth web; the method comprising steps as follows:

bringing the cloth web to a moisture content which does not exceed about 40% by weight, providing a heated drum having a drum axis, providing an inlet roller adjacent to the drum with the inlet roller having an inlet roller axis parallel to the drum axis, running a blanket around an arc of the inlet roller and thence around an arc of the drum in such a manner that a first initially outer surface of the blanket stretches in passing around the arc of the inlet roller and the first surface then contracts as it passes onto the arc of the drum, introducing the moist cloth web onto the first surface of the blanket with the first surface carrying the cloth web in frictional contact therewith as at least a portion of said stretching and at least a portion of said contracting occurs:

the method characterized by:

introducing a smooth strong flexible sheet held in pressing engagement onto the cloth web on the arc of the inlet roller and extending inward of the cloth web onto the arc of the drum, and the sheet being a fabric consisting of resin bonded glass fibers coated with polytetrafluoroethylene resin.

* * * * *